US005162027A

United States Patent [19]

Robinson

[11] Patent Number: 5,162,027

[45] Date of Patent: Nov. 10, 1992

[54] NECK EXERCISING DEVICE AND METHOD

[76] Inventor: Bruce R. Robinson, 200 Goose Hill Manor La., Stevensville, Md. 21666

[21] Appl. No.: 659,029

[22] Filed: Feb. 21, 1991

[51] Int. Cl.[5] ..... A63B 23/025

[52] U.S. Cl. ..... 482/10; 482/105

[58] Field of Search ..... 272/94, 95, 119; 482/10, 11, 105

[56] References Cited

U.S. PATENT DOCUMENTS

| | | | |
|---|---|---|---|
| 500,686 | 7/1893 | Corker | 272/94 |
| 2,051,366 | 8/1936 | Catron | 272/94 |
| 2,855,202 | 10/1958 | Kinne | 272/94 |
| 3,124,353 | 3/1964 | Sharkey | 272/94 |
| 3,128,095 | 4/1964 | Sharkey | 272/94 |
| 3,820,780 | 6/1974 | Tarbox | 272/94 |
| 4,195,833 | 4/1980 | Svendsen | 272/119 X |
| 4,988,093 | 1/1991 | Forrest, Sr. et al. | 272/94 |

FOREIGN PATENT DOCUMENTS

| | | | |
|---|---|---|---|
| 487905 | 11/1952 | Canada | 272/94 |

*Primary Examiner*—Gene Mancene
*Assistant Examiner*—L. Thomas
*Attorney, Agent, or Firm*—Robert P. Cogan

[57] ABSTRACT

A neck exerciser for a user preferably lying prone and moving his head up or down includes a helmet secured to the head by a chinstrap. A selectable number of removable weights are each affixed to a band portion of the helmet. The position of each weight is selectable to produce the maximum movement of force for a given amount of weight so that the maximum training effect is achieved with a minimized amount of weight.

8 Claims, 2 Drawing Sheets

NECK EXERCISING DEVICE AND METHOD

BACKGROUND OF THE INVENTION

The present invention relates to neck exercising devices and more particularly to neck exercising devices worn on the head and to a method for configuring the apparatus for use.

There are prior neck exercising devices in the prior art which comprise some form of apparatus worn on the head and comprising weight supported to the head. While movement of the head with respect to the body is a complex combination of movements, the mathematical model of viewing the head as being simply pivotally supported to the body is useful. In order to keep the head positioned in a predetermined against a moment of force exerted by the weight about the pivot, neck muscles are utilized. Similarly, in order to move the head against the weight, neck muscles are utilized.

There are many prior art schemes for supporting weight to the head for this purpose. A basic apparatus comprising weights supported to the head for posture improvement is illustrated in U.S. Pat. 500,686 issued July 4, 1893 to J. F. Corker. U.S. Pat. 3,820,780 issued June 28, 1974 to E. L. Tarbox disclose a weighted headband comprising fabric filled with shot. The weight is concentrated about the ears of the user. The patent teaches that a total weight for the headband may be selected to be about five percent of user weight. In this apparatus, weight remains fixed for one user, and the positioning of the weight remains fixed with respect to the user.

While such an apparatus may provide a training effect for a user, it is best for a user if the amount of weight can be minimized. When a user is standing with weight supported to the head, compressive force is applied to the spine. This is not beneficial to a user. Also, a common cause of injury to inexperienced users is overexertion. Maximizing the effectiveness of weight used allows for minimizing the amount of weight necessary to achieve a particular training effect. This in turn reduces the chances of overexertion. Also, since the position on the head of the weight is fixed, even if a weight were optimally positioned for one exercise, such as moving the head forward and back, it would not be optimally positioned for an exercise requiring movement in a different plane, such as the exercise of moving the head back and forth. In the present description, the traditional grammatical convention relating to masculine pronouns comprising collective pronouns is followed. In other words references to "he" or "his" with respect to a user do indeed refer to "he or she" or "his or hers."

SUMMARY OF THE INVENTION

It is therefore an object of the present invention to provide a neck exerciser of the type in which weight is supported to the head in which the amount of weight needed to achieve a particular training effect is minimized.

It is a more particular object of the present invention to provide a neck exerciser of the type described in which allows the user to utilize conveniently a selectable amount of weight.

It is another specific object of the present invention to provide a neck exerciser of the type described whereby the user may adjust the position of a weight on a headband to provide for positioning to provide the maximum moment of force with regard to a particular exercise.

It is a further object of the present invention to provide a method for configuring weights on a neck exerciser of the type described.

Briefly stated, in accordance with the present invention, there is provided a neck exerciser including a helmet secured to the head by a chinstrap. A band portion surrounds the head, and a selectable number of removable weights are each affixed to a band portion of the helmet. The position of each weight is selectable to produce the maximum moment of force for a given amount of weight so that the a maximum training effect is achieved with a minimized amount of weight. A user preferably lying prone moves his head up or down or lies on his side and lifts his head to the side in an upward direction while facing to the side. In this manner, compressive force applied to the spine is minimized.

DESCRIPTION OF THE PREFERRED EMBODIMENT

The means by which the foregoing objects and features of invention are achieved are pointed out with particularity in the claims forming the concluding portion of the specification. The invention, both as to its organization and manner of operation may be further understood by reference to following description taken in connection with the following drawings.

DESCRIPTION OF THE PREFERRED EMBODIMENTS

Figure 1:
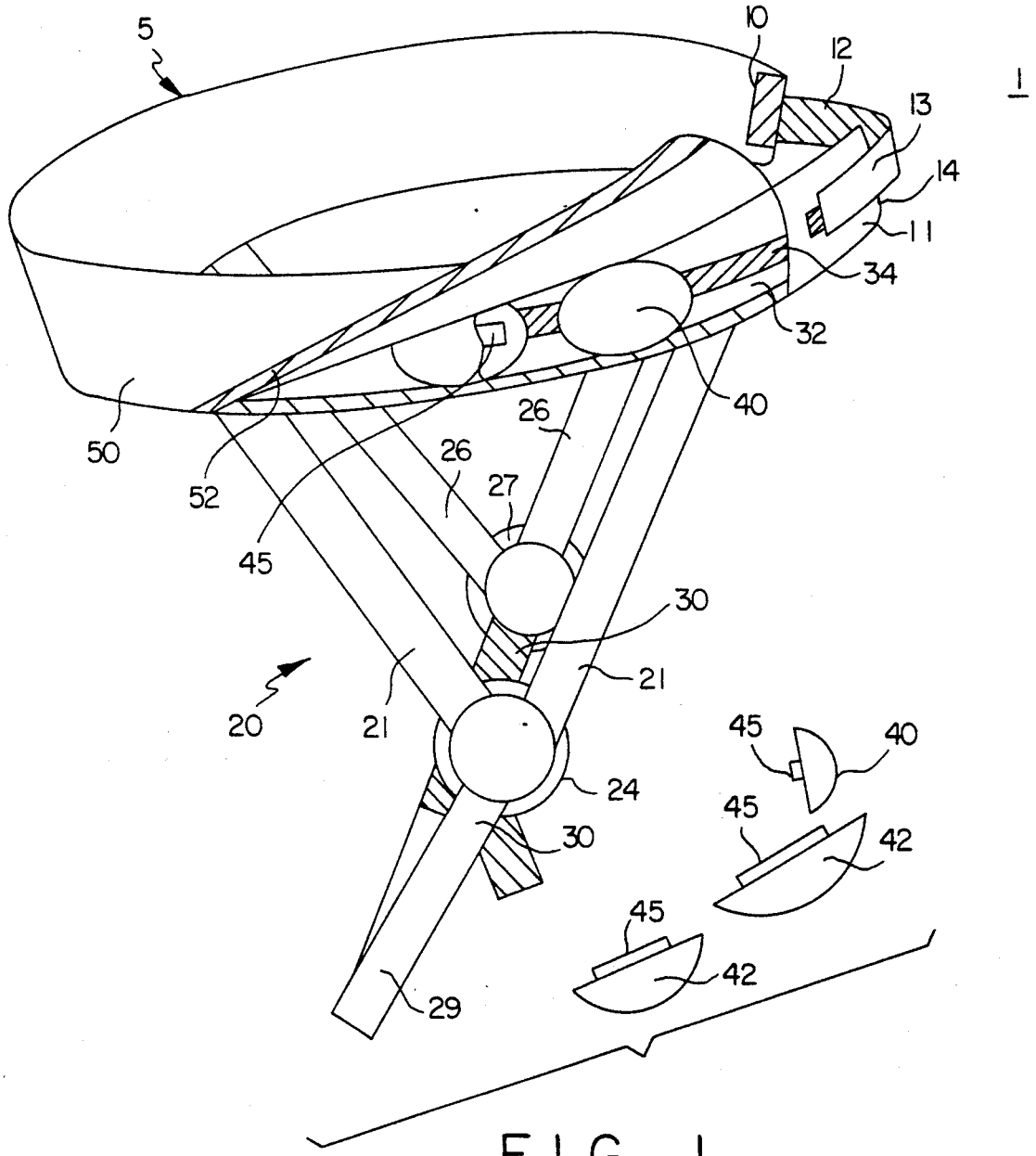
FIG. 1 is an axonometric view of a neck exerciser constructed in accordance with the present invention.
Figure 2:
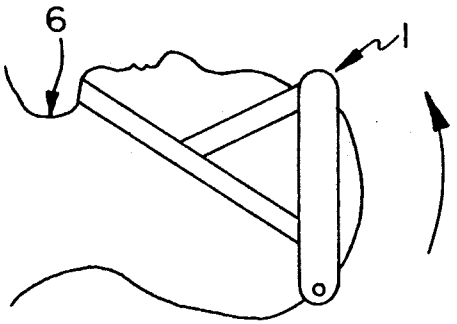
FIGS. 2, 3 and 4 are each a partial elevation of a user demonstrating the use of the present invention.

FIG. 1 is an axonometric view of a neck exerciser constructed in accordance with the present invention. A helmet 1 comprises a band assembly 5 for resting on the head of a user 6 (FIG. 2). The band assembly may be formed to have a fixed circumference or, as in the present embodiment, be adjustable. Ends 10 and 11 of the band member 5 are positionable with respect to each other to provide for a particular user's head size. A strap member 12 extends from side 10 terminated in a closure member 13 for mating with a closure member 14 that is fixed to the end 11. The closure members 13 and 14 could comprise snaps, securing strips sold under the trademark VELCRO or other well-known releasably securable means.

The helmet 1 is secured to a user 6 by a chinstrap strap assembly 20. First and second straps 21 extend downwardly from circumferentially displaced positions on the band assembly 5 on one side of the head of a user 6 and are both secured to a ring 24. Similarly, on the other side of the head of the user 6 first and second straps 26 extend downwardly from circumferentially displaced portions of the band assembly 5 and are joined by a ring 27. A chinstrap 29 is adjustably secured to the rings 24 and 27 by securing means 30. The securing means 30 most conveniently comprises mating VELCRO portions at opposite ends of the strap 29.

The headband assembly 5 comprises a support band 32, conveniently comprised of leather, polyurethane or other material which is both flexible in one degree of freedom and capable of support in another. Multiple releasable securing means 34 are positioned around the circumference of the support band 32. In the present embodiment, the multiple releasable securing means 34 comprises a VELCRO strip extending continuously along the entire circumference of the band 32. Alternatively, reliable securing means could comprise discrete means such as snaps or holes for receiving hooks or many other known forms of releasable securing means.

A plurality of weights 40 are provided. The number of weights is selectable by a user. The weight 40 is illustrated in partially broken away form to illustrate that a releasable securing means 45 is affixed to each weight 40 for securing the weight 40 to the support band 32 by means of securing to a position on the releasable securing means 34. A cloth cover 50 is provided secured circumferentially to the support band 32 at an upper portion thereof and releasably secured thereto circumferentially by releasable securing means 52 at a lower portion thereof. Again, the preferred releasable securing VELCRO, hook and pile fastening means. For purposes of illustration, the cloth cover 50 is shown partially removed from the securing means 52 to expose a first weight 40 as well as a second weight 40, which is partially broken away to illustrate the releasable securing means 45 and its juxtaposition with the support band 32.

Also illustrated are a second set of weights 42, also using releasable securing means 45. Each of the weights 40 has a first weight and each of the weights 42 has a second weight for use as further described below. In a preferred form of utilization of the present invention, the user 6 will select either weights 40 or weights 42 to secure to the support band 32. Weights 40 and 42 not secured to the support band 32 are illustrated in various projections.

Figure 3:
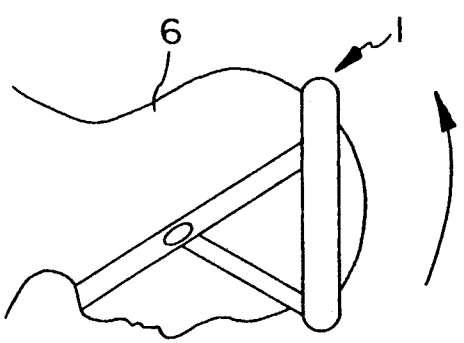
Figure 4:
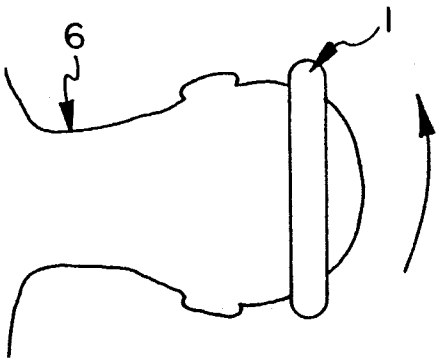

Exemplary uses of the neck exerciser 1 are illustrated in FIGS. 2, 3 and 4 which are each an elevation of the head of a user 6 wearing the neck exerciser 1. In order to exercise front neck muscles, a user 6 lies on his back as in FIG. 2 and raises his head vertically. To exercise back neck muscles, the user 6 lies prone face down as in FIG. 3 and raises his head. In order to exercise the side neck muscles, the user 6 lies prone on one side, as in FIG. 4, and again raises his head.

Figure 5:
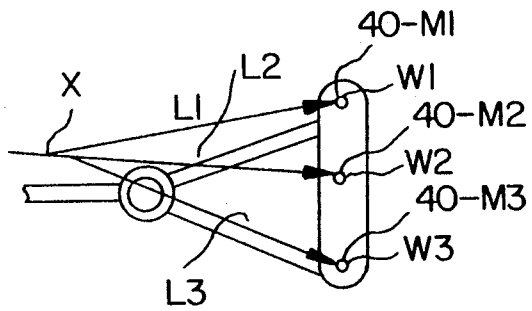
FIG. 5 is a mechanical schematic diagram useful in illustrating placement of weights on a headband in accordance with the present invention.

In accordance with the present invention, the weights 40 are positionable to maximize the training effect for the amount of weight utilized. FIG. 5 is a mechanical schematic diagram of a neck exerciser 1. The symbol X represents the fulcrum of the neck of a user 6. Points W1, W2 and W3 are each a selectable point on the support band 32 to which a weight 40 can be releasably secured. The weights of the weight 40 secured to each of the points W1, W2 and W3 are M1, M2 and M3 respectively. W3 is closer to the front of the head and W1 is closer to the back of the head. The distances from X of W1, W2, and W3 are L1, L2 and L3 respectively. The force exerted on neck muscles at point X is the sum of the moments $L1M1+L2M2+L3M3$. The maximum force on the neck muscles, and consequently the maximum training effect, for a given amount of amount of weight M is achieved by maximizing the length L from the fulcrum X.

It should be noted that the effective position for the fulcrum X is different for the different exercise modes illustrated in FIGS. 2, 3 and 4. The position of the fulcrum X is defined by the mode of exercise selected. Consequently, in use the present invention can optimize use of weight in each exercise mode. The method of the present invention comprises positioning at least one weight 40 to maximize L for the exercise mode currently selected by the user 6. Preferably at least two weights 40 are utilized so that weights are positioned symmetrically with respect to the face of the user 6. Further weights 40 may be positioned at further points to add to the total weight.

In a nominal embodiment, a beginning weight 40 might weigh one quarter pound. A beginning user might wish to start with two weights and build up to using ten weights. A more advanced user might utilize weights selected from the weights 42, which in a nominal embodiment each weigh one half pound. Effective exercise may be achieved using less total weight than in various prior art embodiments.

What is thus provided are a neck exerciser and method in which a selectable number of weights are optimizable positionable and releasably secured to a headband assembly. The above teachings will allow those skilled in the art to make many modifications in the above specific embodiments described herein to provide a neck exerciser and method in accordance with the present invention.

What is claimed as new and desired to be secured by Letters Patent of the United States is:

1. A neck exerciser comprising: a headband assembly for resting on the head of a user, said headband assembly including means defining a support band including a plurality of releasable securing means on a circumference thereof, a plurality of removable weights, each selectably securable to said support band by means of said releasable securing means, each said weight comprising securing means for engagement with said releasable securing means, said releasable securing means being disposed within said support band so that weights may be disposed each at a selected circumferential location on said support band.

2. A neck exerciser according to claim 1 wherein said releasable securing means are formed continuously along along said support band.

3. A neck exerciser according to claim 2 wherein said plurality of weights comprises first and second weights, one being placed on either side of the head of a user.

4. A neck exerciser according to claim 3 wherein said plurality of weights comprises first and second groups of weights, with each weight in each said group of weights having a first and a second value respectively, and wherein all weights secured to said support are selected from the same one of said first or second groups.

5. A neck exerciser according to claim 4 wherein said headband assembly comprises first and second circumferential ends positionable with respect to each other to accommodate a user's head size and means for releasably securing said first and second ends.

6. A neck exerciser according to claim 4 wherein said value of each weight of said first group is one quarter pound.

7. A neck exerciser according to claim 6 wherein the value of each weight of said second group is one half pound.

8. A method for utilizing a neck exerciser comprising the steps of providing a neck exerciser having a headband assembly for resting on the head of a user, said headband assembly including means defining a support band including a releasable securing means on the circumference thereof, and including a plurality of weights, wherein each of said weights may be secured to said releasable securing means; selecting a mode of exercise such that an effective fulcrum on a user is defined, selecting on said releasable securing means at least a first and a second point which are symmetrical with respect to the face of a user and are each at a maximum distance from the fulcrum; and securing one of said weights to said releasable securing means at each said point.

* * * * *